US006035492A

United States Patent [19]

Warshaviak

[11] Patent Number: 6,035,492

[45] Date of Patent: Mar. 14, 2000

[54] HANDLE

[76] Inventor: Jehuda T. Warshaviak, 14 HaHashmonaim Street, Jerusalem (91608), Israel

[21] Appl. No.: 09/111,353

[22] Filed: Jul. 7, 1998

[30] Foreign Application Priority Data

Jul. 11, 1997 [IL] Israel ..... 121287

[51] Int. Cl.[7] ..... A47B 95/02

[52] U.S. Cl. ..... 16/412; 16/438; 16/445; 242/395.1; 74/528; 74/545; 74/548; 292/336.3; 292/DIG. 63

[58] Field of Search ..... 16/112, 123, 126, 16/125, 115, 121; 242/395.1; 74/528, 545, 548; 70/208; 292/336.3, 347, DIG. 31, DIG. 63, 167; D8/306, 347, 308, 338, 336

[56] References Cited

U.S. PATENT DOCUMENTS

| | | | |
|---|---|---|---|
| D. 271,562 | 11/1983 | Weinerman | D8/338 |
| D. 328,231 | 7/1992 | Hansen | D8/301 |
| D. 375,445 | 11/1996 | Harrison et al. | D8/309 |
| 1,203,965 | 11/1916 | Bogenberger . | |
| 2,117,160 | 5/1938 | Gale | 70/208 |
| 2,928,690 | 3/1960 | Larson | 292/336.3 |
| 3,827,739 | 8/1974 | Overholser | 292/347 |
| 4,006,927 | 2/1977 | Recupero | 292/336.3 |
| 4,018,465 | 4/1977 | Ramler | 292/336.3 |
| 4,223,931 | 9/1980 | Neary | 292/347 |
| 4,310,127 | 1/1982 | Yamasaki | 242/395.1 |
| 4,466,658 | 8/1984 | Furst et al. | 74/547 |
| 4,971,375 | 11/1990 | Grecco | 292/347 |
| 5,005,255 | 4/1991 | Paré et al. | 16/115 |
| 5,180,201 | 1/1993 | Hauber | 292/336.3 |
| 5,231,731 | 8/1993 | Jones, Jr. | 16/114 R |
| 5,288,116 | 2/1994 | Donofrio | 292/336.3 |
| 5,368,249 | 11/1994 | Takeuchi | 74/547 |
| 5,400,473 | 3/1995 | Delman | 16/115 |
| 5,425,155 | 6/1995 | Marciniak | 16/112 |
| 5,526,660 | 6/1996 | Bennett et al. | 70/208 |
| 5,560,082 | 10/1996 | Vetter | 16/115 |

FOREIGN PATENT DOCUMENTS

| | | |
|---|---|---|
| 1 157 494 | 11/1963 | Germany . |
| 85 05 588 | 5/1985 | Germany . |
| 4010838 | 10/1991 | Germany . |
| 91 13 481 | 12/1991 | Germany . |
| 312 458 | 6/1929 | United Kingdom . |
| 2 304 370 | 3/1997 | United Kingdom . |

*Primary Examiner*—Chuck Y. Mah

*Attorney, Agent, or Firm*—Marshall, O'Toole, Gerstein, Murray & Borun

[57] ABSTRACT

This invention discloses a handle arranged for driving operation of an axle about an operation axis thereof, the handle including a first element operatively associated with the axle and extending in a first plane perpendicular to the operation axis; and a second element mounted onto the first element and being pivotably mounted with respect to the axle about a second axis lying in the first plane, the second element being arranged with respect to the operation axis so as to be not centered about the axis.

42 Claims, 4 Drawing Sheets

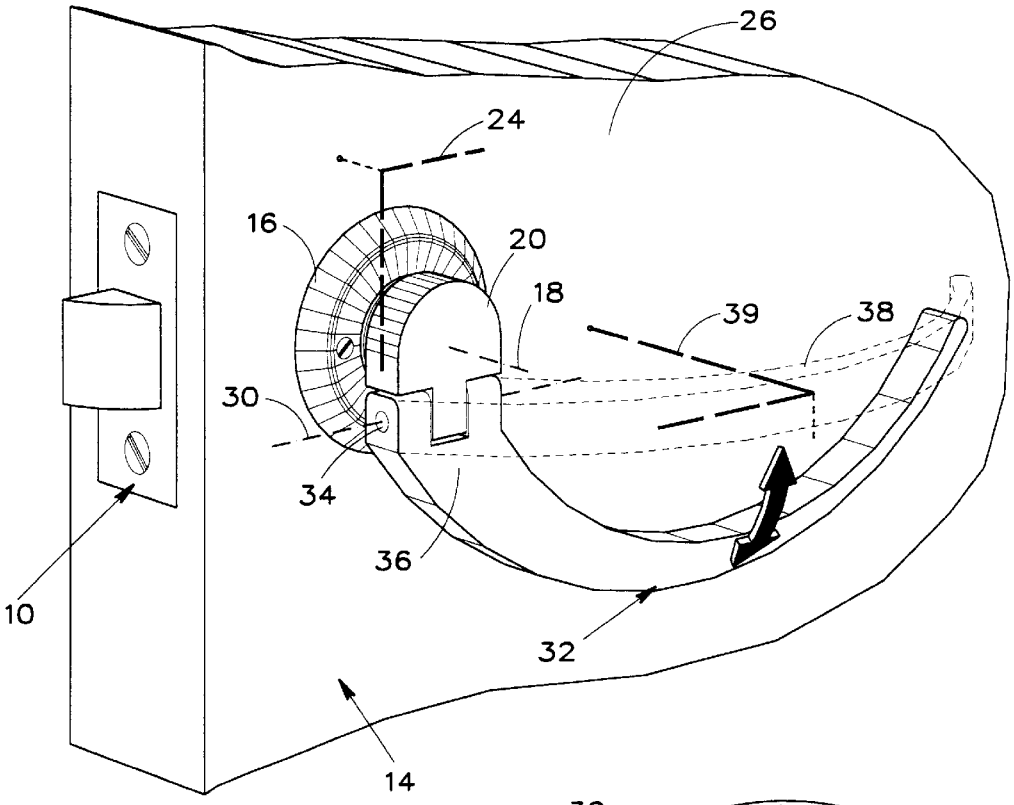
Fig. 1
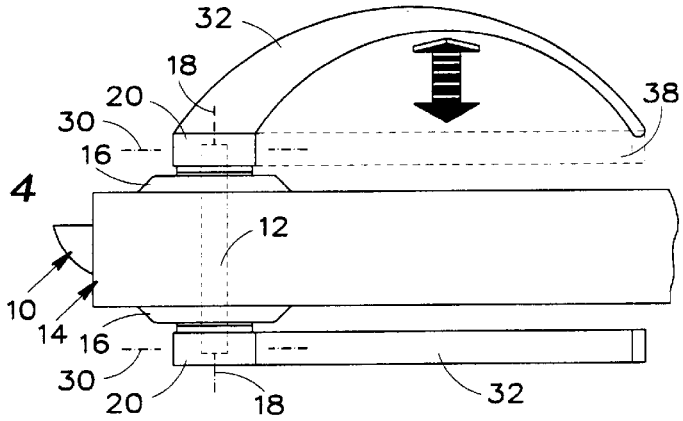
Fig. 4
Fig. 3
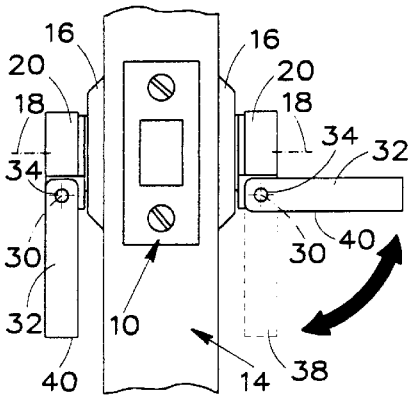
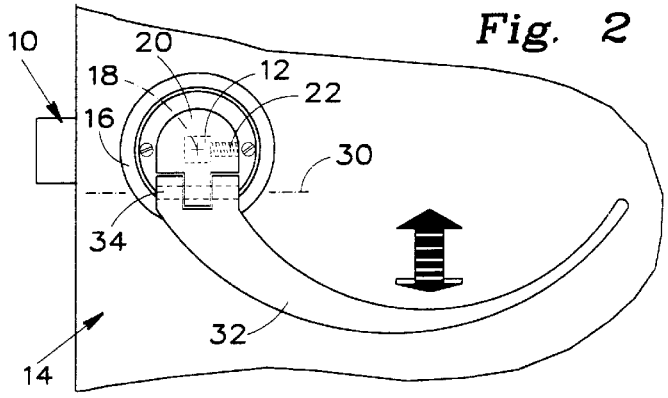
Fig. 2

HANDLE

FIELD OF THE INVENTION

The present invention relates to handles generally and more particularly to handles having more than one degree of motion.

BACKGROUND OF THE INVENTION

A great variety of handles are known in the prior art, including handles for operating door latches and various other devices. Conventional handles include door knobs and door handles which rotate about a single axis. The following U.S. patents are believed to represent the state of the art: U.S. Pat. Nos. 5,425,155; 5,288,116; 5,231,731; 5,005,255; 4,971,375; 4,223,931; 4,018,465; 4,006,927; 3,827,739; 2,928,690; & 1,203,965.

SUMMARY OF THE INVENTION

The present invention seeks to provide an improved handle which is operative with two degrees of freedom.

There is thus provided in accordance with a preferred embodiment of the present invention a handle arranged for driving operation of an axle about an operation axis thereof, the handle including:

- a first element operatively associated with the axle and extending in a first plane perpendicular to the operation axis; and
- a second element mounted onto the first element and being pivotably mounted with respect to the axle about a second axis lying in the first plane, the second element being arranged with respect to the operation axis so as to be not centered about the axis.

There is also provided in accordance with a preferred embodiment of the present invention a handle arranged for driving operation of an axle about an operation axis thereof, the handle including:

- a first element operatively associated with the axle and extending in a first plane perpendicular to the operation axis; and
- a second element mounted onto the first element and being pivotably mounted with respect to the axle about a second axis lying in the first plane, the second element being a generally elongate element which extends generally parallel to the second axis.

In accordance with one embodiment of the present invention, the second axis intersects the operation axis.

In accordance with another embodiment of the present invention, the second axis does not intersect the operation axis.

In accordance with one embodiment of the present invention, the second element has first and second ends, both of which are attached to the first element.

In accordance with another embodiment of the present invention, the second element has first and second ends, only one of which is attached to the first element.

Preferably, the pivotable mounting of the second element onto the first element is such that gravity causes the second element to lie in the first plane and that a user, grasping the second element may readily pivot it so as to lie in a second plane, perpendicular to the first plane.

BRIEF DESCRIPTION OF THE DRAWINGS

The present invention will be understood and appreciated more fully from the following detailed description, taken in conjunction with the drawings in which:

FIG. 1 is a pictorial illustration of a door latch assembly constructed and operative in accordance with a preferred embodiment of the present invention;

FIG. 2 is a plan view illustration of the door latch assembly of FIG. 1;

FIG. 3 is a edge view illustration of the door latch assembly of FIGS. 1 & 2;

FIG. 4 a top view illustration of the door latch assembly of FIGS. 1 & 2;

DETAILED DESCRIPTION OF PREFERRED EMBODIMENTS

Figure 5:
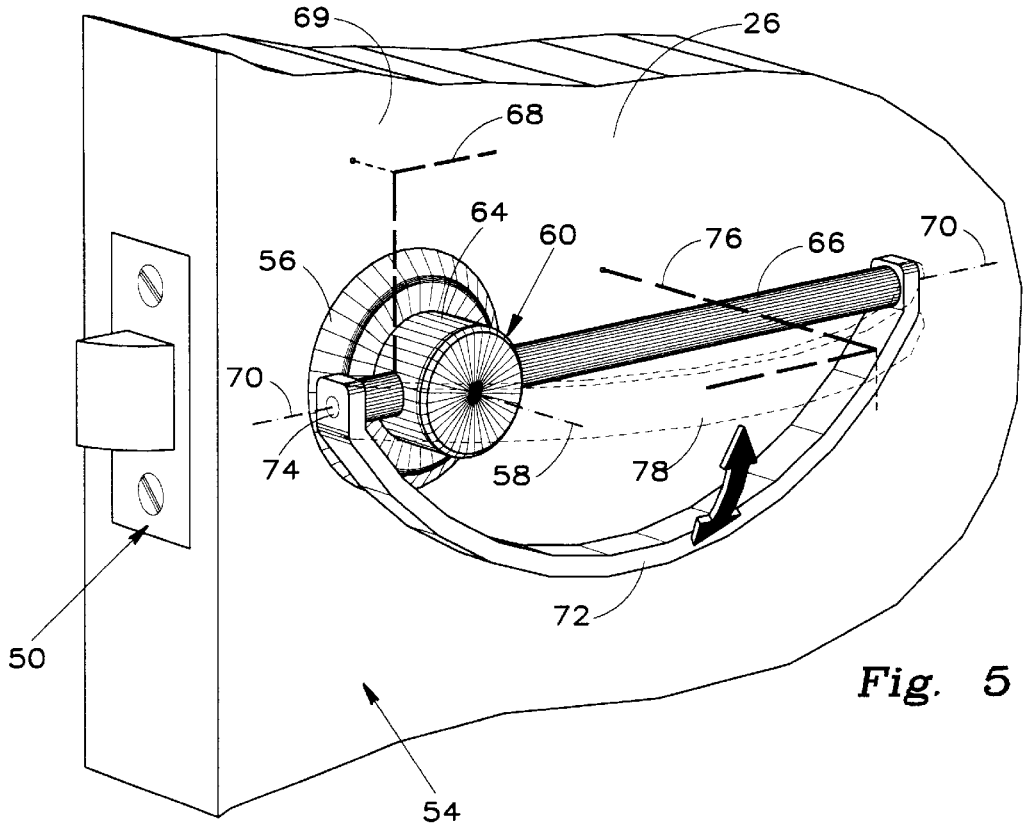
FIG. 5 is a pictorial illustration of a door latch assembly constructed and operative in accordance with another preferred embodiment of the present invention.

Reference is now made to FIGS. 1–4, which illustrate a door latch assembly constructed and operative in accordance with a preferred embodiment of the present invention. The door latch assembly may comprise a conventional door latch mechanism, indicated by reference numeral 10, which includes an operating axle 12 which preferably extends from side to side through apertures formed in a door 14. Rosettes 16 are preferably formed on both sides of the door 14 surrounding the axle 12. Axle 12 is rotatable about its own operation axis 18 for operating the door latch mechanism 10.

Preferably, on each side of the door there is fixedly mounted onto an end of axle 12 a first element 20. Preferably such mounting is achieved by means of a set screw assembly 22. In the illustrated embodiment of FIGS. 1–4, the first element 20 lies in a first plane 24, which extends generally perpendicular to operation axis 18 and parallel to the planar surface 26 of the door 14.

In accordance with a preferred embodiment of the present invention, normally the small separation between the first plane 24 and the planar surface 26 of the door 14 and the relatively small thickness of the first element is such that clothing does not inadvertently become caught on the first element 20.

The first element 20 defines a second axis 30, perpendicular to operation axis 18, onto which is pivotably mounted a second element 32, preferably by means of a hinge pin 34. In the illustrated embodiment, the second axis 30 does not intersect the operation axis 18. The second element 32 is shown in FIGS. 1–4 as a curved handle, which is mounted at one end 36 thereof onto the first element 20 for rotation about second axis 30.

It is a particular feature of the present invention that the second element 32 is arranged with respect to the operation axis 18 so as to be not centered about the axis 18.

It is also a particular feature of the present invention that the second element 32 is a generally elongate element which extends generally parallel to the second axis 30.

Preferably, the pivotable mounting of the second element 32 onto the first element 20 is such that gravity causes the second element 32 to lie in the first plane 24, as shown in phantom in FIG. 3 at reference numeral 38 and that a user, grasping the second element 32, may readily pivot it so as to cause it to lie in a second plane 39, perpendicular to the first plane 24, as shown in solid lines at reference numeral 40.

It is a particular feature of the present invention that when the second element 32 lies in the first plane 24, under the influence of gravity, the small separation between the first plane 24 and the planar surface 26 of the door 14 is sufficiently small that clothing does not inadvertently become caught between the second element 32 and the planar surface 26 of the door 14.

Figure 6:
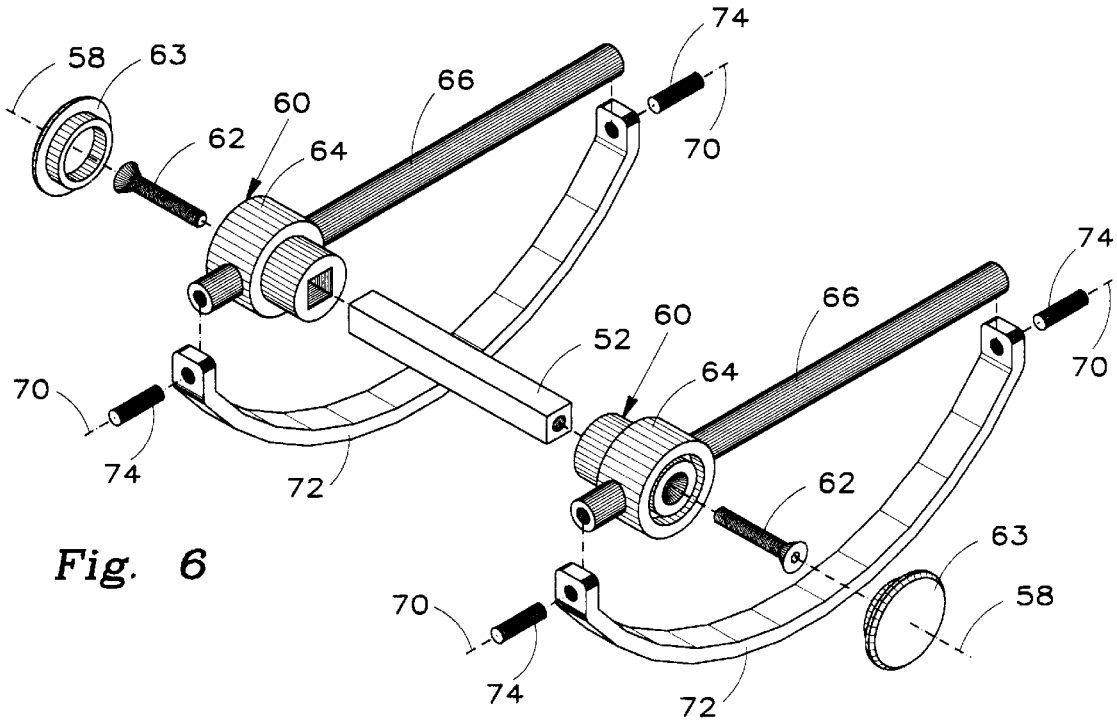
FIG. 6 if an exploded view illustration of a handle assembly employed in the door latch assembly of FIG. 5.

Reference is now made to FIGS. 5 and 6 which illustrate a door latch assembly constructed and operative in accordance with another preferred embodiment of the present invention. The door latch assembly of FIGS. 5 and 6 may comprise a conventional door latch mechanism, indicated by reference numeral 50, which includes an operating axle 52, which preferably extends from side to side through apertures formed in a door 54. Rosettes 56 are preferably formed on both sides of the door 54 surrounding the axle 52. Axle 52 is rotatable about its own operation axis 58 for operating the door latch mechanism 50.

On each side of the door there is preferably fixedly mounted onto an end of axle 52 a first element 60. Preferably such mounting is achieved by means of a screw 62, which may be covered by a escutcheon 63, which may be padded. In the illustrated embodiment of FIGS. 5 & 6, the first element 60 includes a hub portion 64, which is fixedly seated onto an end of axle 52 and through which extends a rod 66, preferably in a nonsymmetrical arrangement as shown. Hub 64 and rod 66 may be integrally formed as one piece or alternatively may comprise separate sub-elements which may be fixed together.

The first element 60 lies generally in a first plane 68, which extends generally perpendicular to operation axis 58 and preferably parallel to the planar surface 69 of the door 54. In accordance with a preferred embodiment of the present invention, the first plane 68 lies very close to the planar surface 69 of the door 54 and is separated therefrom by a distance which is normally not sufficient to permit a user's fingers to be inserted between the first element 60 and the planar surface 69 of the door 54. Normally the small separation between the first plane 68 and the planar surface 69 of the door 54 is sufficiently small that clothing does not inadvertently become caught between the first element 60 and the planar surface 69 of the door 54.

The first element 60 defines a second axis 70, perpendicular to operation axis 58. A second element 72, which is preferably a curved handle element, is pivotably mounted at its ends, as by pins 74, onto respective ends of the first element 60 for pivotable rotation about second axis 70. In the illustrated embodiment of FIGS. 5 and 6, the second axis 70 does intersect the operation axis 58.

It is a particular feature of this embodiment of the present invention that the second element 72 is arranged with respect to the operation axis 58 so as to be not centered about the axis 58.

It is also a particular feature of the present invention that the second element 72 is a generally elongate element which extends along the second axis 70.

Preferably, the pivotable mounting of the second element 72 onto the first element 60 is such that gravity causes the second element 72 to lie in the first plane 68, as shown in solid lines in FIG. 5 and that a user, grasping the second element 72 by inserting his fingers between the first element 60 and the second element 72 so as to at least partially surround the second element 72, may readily pivot it so as to lie in a second plane 76, perpendicular to the first plane 68, as shown in phantom at reference numeral 78.

It is a particular feature of the present invention that when the second element 72 lies in the first plane 68, under the influence of gravity, the small separation between the first plane 68 and the planar surface 69 of the door 54 is sufficiently small that clothing does not inadvertently become caught between the second element 72 and the planar surface 69 of the door 54.

Figure 7:
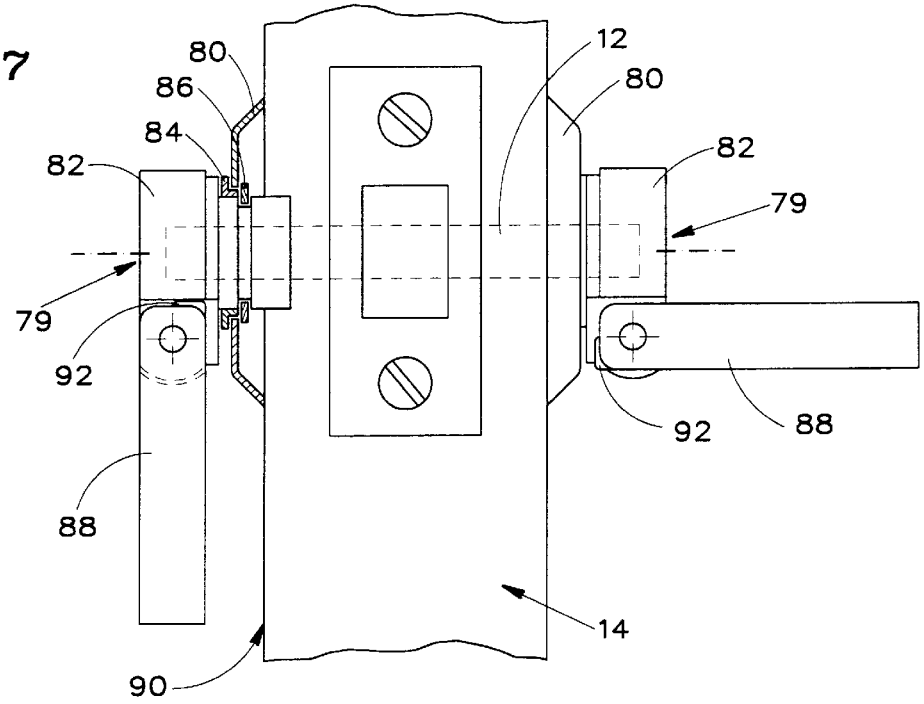
FIG. 7 is a partially sectional illustration of a variation of the embodiment of FIGS. 1–4.

Reference is now made to FIG. 7 which is a partially sectional illustration of a variation of the embodiment of FIGS. 1–4. In this variation handle assemblies 79 are retained in operative engagement with axle 12 (FIG. 1) by means of rosettes 80 which are fixed onto the door 14 as by screws (not shown). The first element 82 of handle assembly 79 is rotatably retained onto the rosette 80 by means of a pair of bearing rings 84 and 86.

Rotation of the second element 88 of handle assembly 79 beyond the vertical in a direction indicated by reference numeral 90 is prevented by provision of a stopper protrusion 92 mounted on either or both of the first and second elements 82 and 88. Such rotation could otherwise allow the second element to come into engagement with the door 14 (FIG. 1) and damage it.

Figure 8:
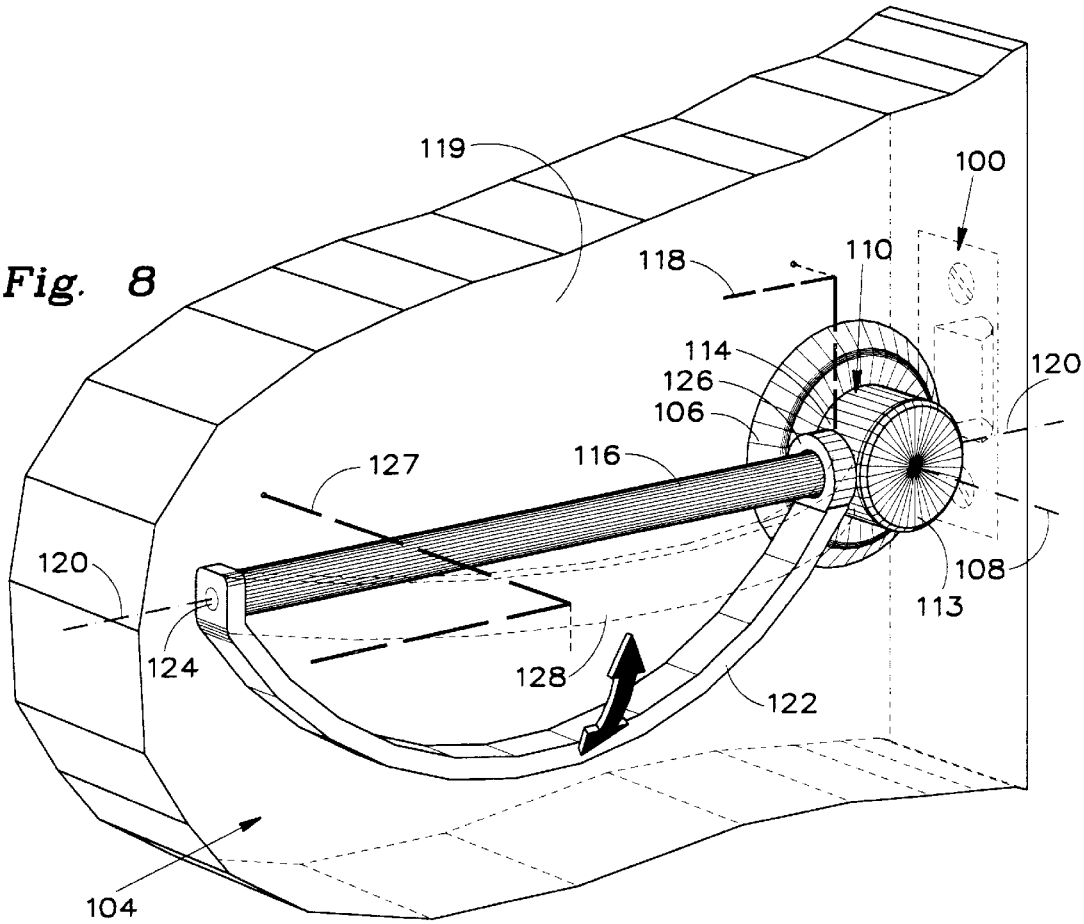
FIG. 8 is a pictorial illustration of a door latch assembly constructed and operative in accordance with yet another preferred embodiment of the present invention.

Reference is now made to FIG. 8 which illustrates a door latch assembly constructed and operative in accordance with another preferred embodiment of the present invention. The door latch assembly of FIG. 8 may comprise a conventional door latch mechanism, indicated by reference numeral 100, which includes an operating axle (not shown) which preferably, but not necessarily, extends from side to side through apertures formed in a door 104. A rosette 106 is preferably formed on each side of the door 104 surrounding the axle, which is rotatable about its own operation axis 108, for operating the door latch mechanism 100.

On each side of the door 104 there is preferably fixedly mounted onto an end of the axle a first element 110. Preferably such mounting is achieved by means of a screw (not shown), which may be covered by a escutcheon 113, which may be padded.

In the illustrated embodiment of FIG. 8, the first element 110 includes a hub portion 114 which is fixedly seated onto an end of the axle and from one end of which extends a rod 116, in a non-symmetrical arrangement as shown. Hub 114 and rod 116 may be integrally formed as one piece or alternatively may comprise separate sub-elements which may be fixed together.

As in the embodiment of FIGS. 5 and 6, the first element 110 lies generally in a first plane 118, which extends generally perpendicular to operation axis 108 and preferably parallel to the planar surface 119 of the door 104.

In accordance with a preferred embodiment of the present invention, the first plane 118 lies very close to the planar surface 119 of the door 104 and is separated therefrom by a distance which is normally not sufficient to permit a user's fingers to be inserted between the first element 110 and the planar surface 119 of the door 104. Normally the small separation between the first plane 118 and the planar surface 119 of the door 104 is sufficiently small that clothing does not inadvertently become caught between the first element 110 and the planar surface 119 of the door 104.

The first element 110 defines a second axis 120, perpendicular to operation axis 108. A second element 122, which is preferably a curved handle element, is pivotably mounted at its ends, as by a pin 124 and a socket 126, onto rod 116 on one side of hub 114 for pivotable rotation about second axis 120, defined by rod 116. In the illustrated embodiment of FIG. 8, the second axis 120 does intersect the operation axis 108.

It is a particular feature of this embodiment of the present invention that the second element 122 is arranged with respect to the operation axis 108 so as to be not centered about the axis.

It is also a particular feature of the present invention that the second element 122 is a generally elongate element which extends parallel to the second axis 120.

Preferably, the pivotable mounting of the second element 122 onto the first element 110 is such that gravity causes the second element 122 to lie in the first plane 118, as shown in solid lines in FIG. 8 and that a user, grasping the second element 122, may readily pivot it so as to lie in a second plane 127, perpendicular to the first plane 118, as shown in phantom at reference numeral 128.

It is a particular feature of the present invention that when the second element 122 lies in the first plane 118, under the influence of gravity, the small separation between the first plane 118 and the planar surface 119 of the door 104 is sufficiently small that clothing of a user does not inadvertently become caught between the second element 122 and the planar surface 119 of the door 104.

Figure 9A:
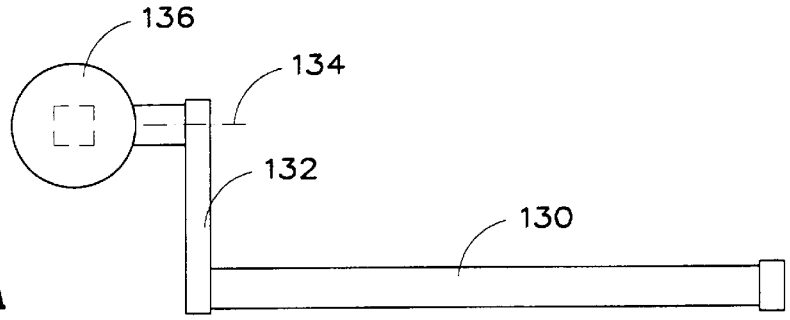
FIGS. 9A, 9B, 9C and 9D are illustrations of four additional alternative embodiments of handle assemblies constructed and operative in accordance with a preferred embodiment of the present invention.

Reference is now made to FIGS. 9A, 9B, 9C and 9D, which are illustrations of four additional alternative embodiments of handle assemblies constructed and operative in accordance with a preferred embodiment of the present invention. FIG. 9A illustrates an embodiment wherein the second element comprises a straight handle element 130 fixedly mounted onto an attachment element 132, which, in turn, is pivotably mounted about a second axis 134 extending to one side of a first element 136.

Figure 9B:
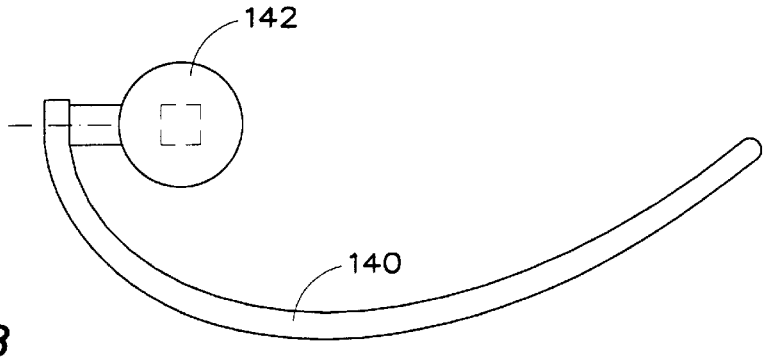
Figure 9C:
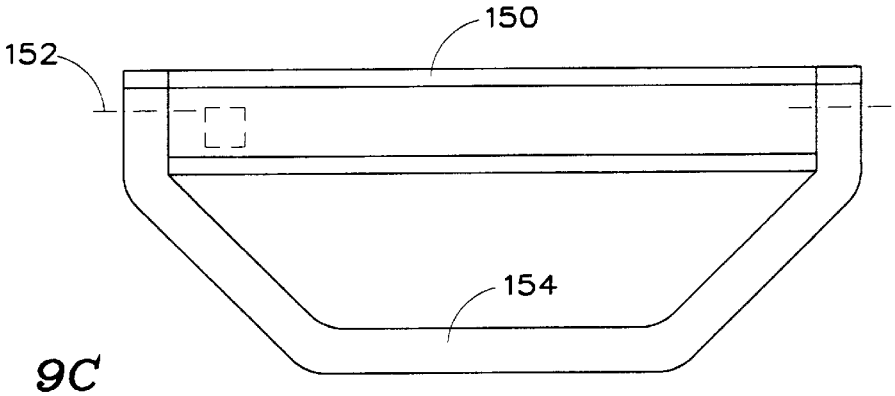

FIG. 9B illustrates an embodiment wherein the second element is a curved handle 140 which extends from one side of a first element 142 to the other side thereof. FIG. 9C illustrates a hubless embodiment wherein the first element comprises a shaft 150, onto the ends of which are pivotably mounted respective ends of a handle 154 for rotation about an axis 152.

Figure 9D:
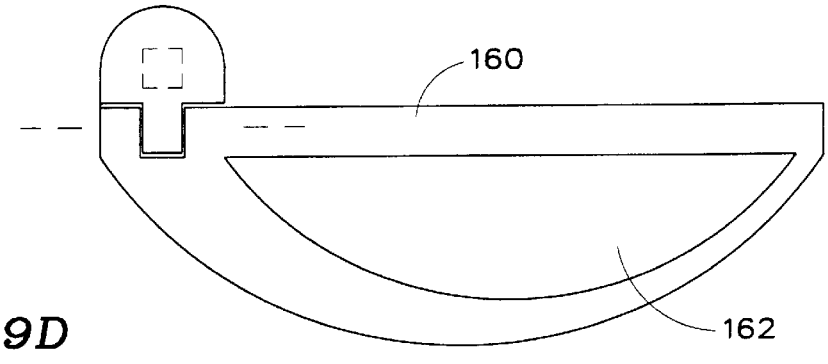

FIG. 9D illustrates a variation of the embodiment of FIGS. 1–4 wherein the second element comprises a closed handle 160 defining an opening 162 through which the fingers of a user can extend during operation of the handle.

It is to be appreciated that the present invention is not limited in its applicability to door latches or to any other type of latch. The present invention is suitable for use in driving any suitable rotatable axle which drives a mechanism of any suitable type. It will be appreciated by persons skilled in the art that the present invention is not limited by what has been particularly shown and described hereinabove. Rather the present invention includes both combinations and subcombinations of various features described hereinabove, as well as variations and further developments of those features which would occur to a person skilled in the art upon reading the foregoing description and which are not in the prior art.

I claim:

1. A handle arranged for driving operation of an axle about an operation axis thereof, the handle comprising:

a first element operatively associated with an axle and extending in a first plane perpendicular to the operation axis; and a second element mounted onto the first element and being pivotably mounted with respect to the axle about a second axis lying in the first plane, the second element being arranged with respect to the operation axis so that a midpoint along a length of said second element does not intersect the operation axis.

2. Apparatus according to claim 1 and wherein the second axis intersects the operation axis.

3. Apparatus according to claim 1 and wherein the second axis does not intersect the operation axis.

4. Apparatus according to claim 1 and wherein said second element has first and second ends, both of which are attached to the first element.

5. Apparatus according to claim 1 and wherein said second element has first and second ends only one of which is attached to the first element.

6. Apparatus according to claim 1 and wherein pivotable mounting of the second element onto the first element is such that gravity causes the second element to lie in the first plane and that a user, grasping the second element, may readily pivot it so as to lie in a second plane, perpendicular to the first plane.

7. Apparatus according to claim 1 and also including a rotation limiter for limiting the extent of rotation of the second element relative to the first element about the second axis.

8. Apparatus according to claim 1 and also comprising a latch driven by said axle.

9. Apparatus according to claim 1 and also comprising a mechanism driven by said axle.

10. A handle according to claim 1 and wherein:

said first element comprises an elongate element having first and second ends;

said second element comprises a curved element having first and second ends;

the first end of said second element is pivotably mounted onto the first end of said first element; and the second end of said second element is pivotably mounted onto the second end of said first element.

11. A handle according to claim 10 and wherein said first element intersects said operation axis.

12. A handle according to claim 10 and wherein said second element normally lies in said first plane under the force of gravity.

13. A handle according to claim 10 and wherein said first and second ends of said first and second elements lie on respective first and second sides of said operation axis.

14. A handle according to claim 10 and wherein said curved element and said elongate element together define a region adapted for engagement by a human hand.

15. A handle according to claim 10 and wherein said curved element lies generally along a part of a circle which is not centered on said operation axis.

16. A handle arranged for driving operation of an axle about an operation axis thereof, the handle comprising:

a first element operatively associated with an axle and extending in a first plane perpendicular to the operation axis; and a second element mounted onto the first element and being pivotably mounted with respect to the axle about a second axis lying in the first plane, the second element being a generally elongate element which extends generally parallel to the second axis, the second element being arranged with respect to the operation axis so that a midpoint along a length of said second element does not intersect the operation axis.

17. Apparatus according to claim 16 and wherein the second axis intersects the operation axis.

18. Apparatus according to claim 16 and wherein the second axis does not intersect the operation axis.

19. Apparatus according to claim 16 and wherein said second element has first and second ends, both of which are attached to the first element.

20. Apparatus according to claim 16 and wherein said second element has first and second ends only one of which is attached to the first element.

21. Apparatus according to claim 16 and wherein pivotable mounting of the second element onto the first element is such that gravity causes the second element to lie in the first plane and that a user, grasping the second element, may readily pivot it so as to lie in a second plane, perpendicular to the first plane.

22. Apparatus according to claim 16 and also including a rotation limiter for limiting the extent of rotation of the second element relative to the first element about the second axis.

23. Apparatus according to claim 16 and also comprising a latch driven by said axle.

24. Apparatus according to claim 16 and also comprising a mechanism driven by said axle.

25. A door latch assembly comprising:

a handle arranged for driving operation of an axle about an operation axis thereof, the handle including:

a first element operatively associated with an axle and extending in a first plane perpendicular to the operation axis; and a second element mounted onto the first element and being pivotably mounted with respect to the axle about a second axis lying in the first plane, the second element being arranged with respect to the operation axis so that a midpoint along a length of said second element does not intersect the operation axis; and a door latch mechanism driven by said axle.

26. Apparatus according to claim 25 and wherein the second axis intersects the operation axis.

27. Apparatus according to claim 25 and wherein the second axis does not intersect the operation axis.

28. Apparatus according to claim 25 and wherein said second element has first and second ends, both of which are attached to the first element.

29. Apparatus according to claim 25 and wherein said second element has first and second ends only one of which is attached to the first element.

30. Apparatus according to claim 25 and wherein pivotable mounting of the second element onto the first element is such that gravity causes the second element to lie in the first plane and that a user, grasping the second element may readily pivot it so as to lie in a second plane, perpendicular to the first plane.

31. Apparatus according to claim 25 and also including a rotation limiter for limiting the extent of rotation of the second element relative to the first element about the second axis.

32. A door latch assembly according to claim 25 and wherein:

said first element comprises an elongate element having first and second ends;

said second element comprises a curved element having first and second ends;

the first end of said second element is pivotably mounted onto the first end of said first element; and the second end of said second element is pivotably mounted onto the second end of said first element.

33. A door latch assembly according to claim 32 and wherein:

said axle is mounted on a door at an operation axis location spaced from an edge of said door by a separation distance;

said first and second elements are configured and arranged relative to said operation axis in a first orientation whereby neither said first nor said second elements extend beyond an edge of said door when rotated about said operation axis up to 90 degrees from said first orientation.

34. A door latch assembly according to claim 25 and wherein said axle is mounted on a door at an operation axis location spaced from an edge of said door by a separation distance;

said first and second elements are configured and arranged relative to said operation axis in a first orientation whereby neither said first nor said second elements extend beyond an edge of said door when rotated about said operation axis up to 90 degrees from said first orientation.

35. A door latch assembly according to claim 25 and wherein pivotable mounting of said second element onto said first element is such that gravity causes the second element to lie in the first plane.

36. A door latch assembly comprising:

a handle arranged for driving operation of an axle about an operation axis thereof, the handle including:

a first element operatively associated with an axle and extending in a first plane perpendicular to the operation axis; and a second element mounted onto the first element and being pivotably mounted with respect to the axle about a second axis lying in the first plane, the second element being a generally elongate element which extends generally parallel to the second axis, the second element being arranged with respect to the operation axis so that a midpoint along a length of said second element does not intersect the operation axis; and a door latch mechanism driven by said axle.

37. Apparatus according to claim 36 and wherein the second axis intersects the operation axis.

38. Apparatus according to claim 36 and wherein the second axis does not intersect the operation axis.

39. Apparatus according to claim 36 and wherein said second element has first and second ends, both of which are attached to the first element.

40. Apparatus according to claim 36 and wherein said second element has first and second ends only one of which is attached to the first element.

41. Apparatus according to claim 36 and wherein pivotable mounting of the second element onto the first element is such that gravity causes the second element to lie in the first plane and that a user, grasping the second element may readily pivot it so as to lie in a second plane, perpendicular to the first plane.

42. Apparatus according to claim 36 and also including a rotation limiter for limiting the extent of rotation of the second element relative to the first element about the second axis.

* * * * *

UNITED STATES PATENT AND TRADEMARK OFFICE

CERTIFICATE OF CORRECTION

PATENT NO. : 6,035,492
DATED : March 14, 2000
INVENTOR(S) : Jehuda T. Warshaviak It is certified that error appears in the above-identified patent and that said Letters Patent is hereby corrected as shown below:

In Section [56] References Cited

Please insert the following references under
FOREIGN PATENT DOCUMENTS:

| | | | | |
|---|---|---|---|---|
| -- | 237070 | 12/1994 | Taiwan | |
| | 237890 | 1/1995 | Taiwan | |
| | 256273 | 9/1995 | Taiwan | |
| | 256274 | 9/1995 | Taiwan | |
| | 307295 | 6/1997 | Taiwan | -- |

Signed and Sealed this

Twenty-sixth Day of June, 2001

*Attest:*

Nicholas P. Godici

*Attesting Officer*

NICHOLAS P. GODICI
*Acting Director of the United States Patent and Trademark Office*